United States Patent [19]

Maybell et al.

[11] 4,087,822

[45] May 2, 1978

[54] RADIO FREQUENCY ANTENNA HAVING MICROSTRIP FEED NETWORK AND FLARED RADIATING APERTURE

[75] Inventors: Michael J. Maybell; George S. Hardie, both of Santa Barbara, Calif.

[73] Assignee: Raytheon Company, Lexington, Mass.

[21] Appl. No.: 717,855

[22] Filed: Aug. 26, 1976

[51] Int. Cl.[2] ..... H01Q 3/26; H01Q 13/08

[52] U.S. Cl. ..... 343/778; 343/783; 343/854; 343/911 R

[58] Field of Search ..... 343/783, 786, 854, 911 R, 343/778

[56] References Cited

U.S. PATENT DOCUMENTS

| | | | |
|---|---|---|---|
| 2,822,541 | 2/1958 | Sichak et al. | 343/786 |
| 3,524,192 | 8/1970 | Sakiotis et al. | 343/911 R |
| 3,979,754 | 9/1976 | Archer et al. | 343/854 |

*Primary Examiner*—Eli Lieberman

*Attorney, Agent, or Firm*—Richard M. Sharkansky; Joseph D. Pannone

[57] ABSTRACT

A radio frequency antenna having a microstrip feed network and a flared radiating structure directly fed by such microstrip feed network. A wedge-shaped dielectric structure is disposed in the narrow region of the flared radiating structure to match the impedance of the antenna to the impedance of free space. An E-plane array antenna includes a plurality of antenna elements, each including a single feed element on a dielectric board. An H-plane array antenna includes a plurality of feed elements on a single dielectric board. A cover, having an absorbing material, is disposed over the microstrip feed network to suppress stray radiation from propagating from such feed network.

10 Claims, 5 Drawing Figures

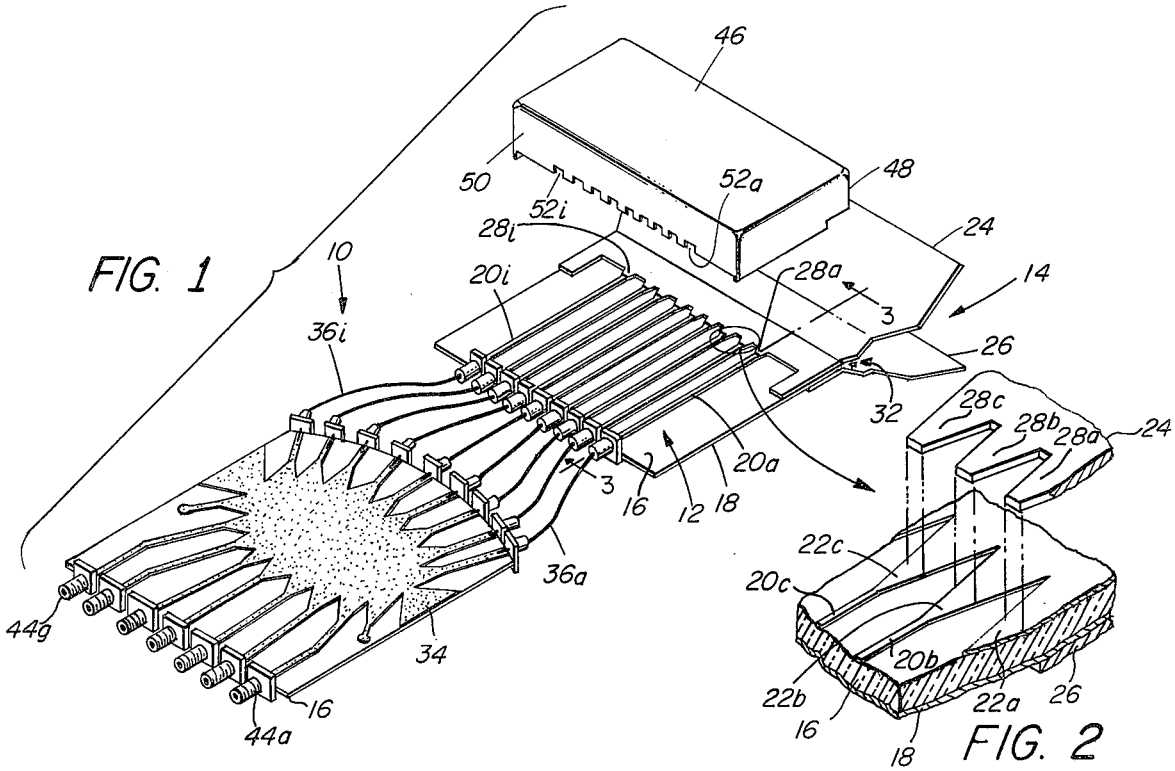
FIG. 1
FIG. 2
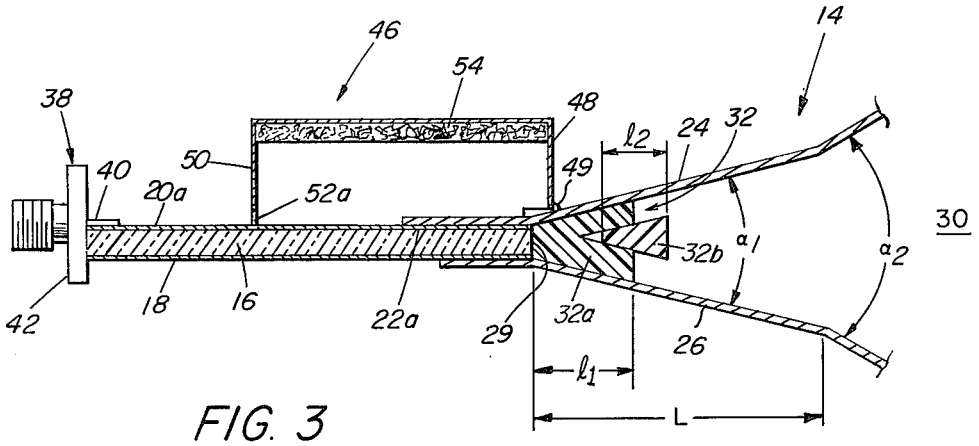
FIG. 3

RADIO FREQUENCY ANTENNA HAVING MICROSTRIP FEED NETWORK AND FLARED RADIATING APERTURE

BACKGROUND OF THE INVENTION

This invention relates generally to radio frequency antennas and more particularly to radio frequency antennas adapted to produce fan-shaped radiation patterns.

As is known in the art, a sectoral horn may be used to produce a fan-shaped radiation pattern. Such an antenna generally includes a rectangular waveguide, one end of which is flared in only one dimension. An electric field is produced within the horn, such field being aligned parallel to a pair of the four conductive walls defining such horn. Therefore, the electric field at the pair of walls becomes zero with the result that a cosine illumination, rather than the generally more desirable completely uniform illumination, is formed across the face of the horn. Further, the weight, fabrication cost and space occupied by such a sectoral horn sometimes limits the applications in which such horn may be used.

SUMMARY OF THE INVENTION

With the background of the invention in mind it is an object of this invention to provide an improved, compact, lightweight, inexpensive radio frequency antenna adapted to produce a fan-shaped radiation pattern having relatively uniform illumination across the face of such antenna.

This and other objects of the invention are attained generally by providing a radio frequency antenna comprising a microstrip feed network and a flared radiating structure directly fed by such microstrip feed network. The microstrip feed network includes a dielectric board having a conductive ground plane formed on one side thereof and at least one feed element formed on the other side of such dielectric board. The flared radiating structure includes a pair of conductive members, one being connected to the conductive ground plane and the other being connected to at least one feed element. The radiating structure is flared outwardly from the edge of the dielectric board to free space. A wedge-shaped dielectric structure is disposed in the narrow region of the flared radiating structure for the purpose of matching the impedance of the antenna to the inpedance of free space.

In one embodiment of the invention a single feed element is formed on the dielectric board to form an antenna element. A plurality of such antenna elements is arranged with the dielectric boards thereof disposed in parallel planes to form an E-plane array antenna.

In another embodiment of the invention a plurality of feed elements is formed to provide an H-plane array antenna on a single dielectric board.

A cover, having absorbing material, is disposed over the microstrip feed network to suppress stray radiation from propagating from such feed network.

BRIEF DESCRIPTION OF THE DRAWINGS

The foregoing features of this invention, as well as the invention itself, may be more fully understood from the following detailed description read together with the accompanying drawings in which:

FIG. 1 is an isometric drawing, partially exploded, of an H-plane radio frequency array antenna according to the invention;

FIG. 2 is an exploded view of a portion of the antenna shown in FIG. 1;

FIG. 3 is a cross-section view of a portion of the antenna shown in FIG. 1 taken along line 3—3;

DESCRIPTION OF THE PREFERRED EMBODIMENTS

Figure 4:
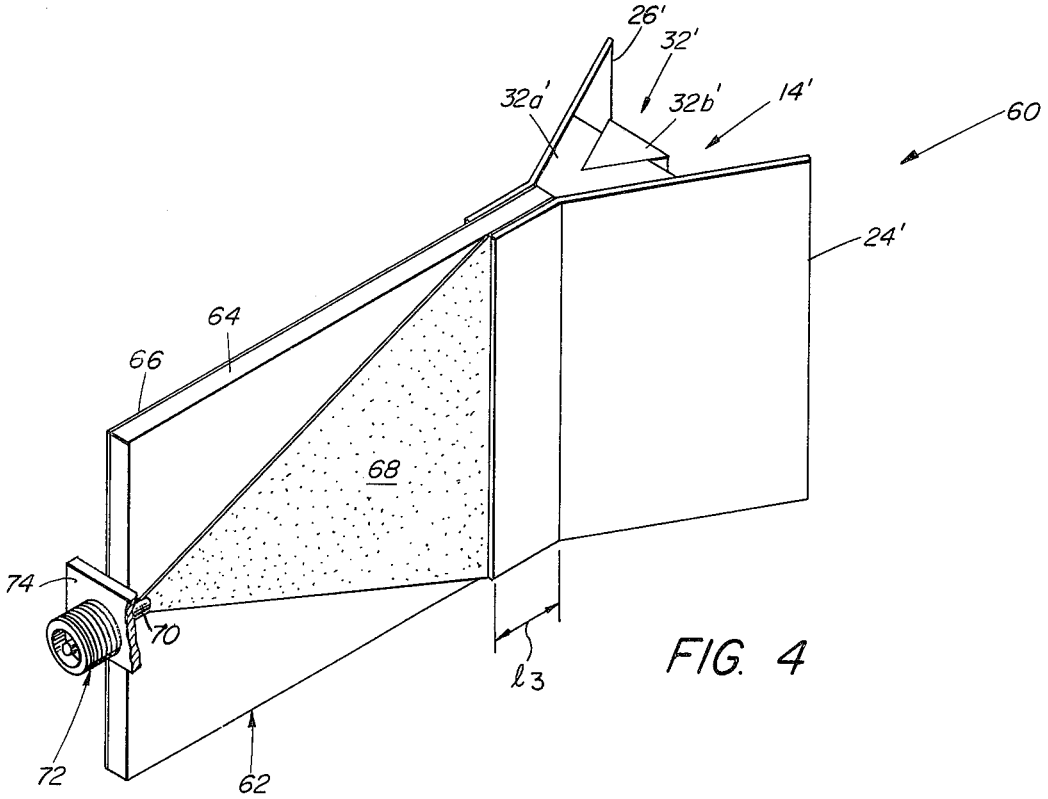
FIG. 4 is an isometric drawing of an antenna element according to the invention; and, FIG. 5 is an isometric drawing, somewhat simplified, of an E-plane radio frequency array antenna using a plurality of the antenna elements shown in FIG. 4.

Referring now to FIG. 1, an H-plane radio frequency array antenna 10, here adapted to operate over the frequency band 6–18 GHz, is shown to include a microstrip feed network 12 and a flared radiating structure 14 directly fed by such microstrip feed network 12. The microstrip feed network 12 includes a dielectric board 16, here RT/duroid 5880 manufactured by Rogers Corp., Rogers, Connecticut, having a dielectric constant of 2.22 and a thickness of 0.03 inches. A copper ground plane 18 is formed on one side of the dielectric board 16 (shown in FIG. 2) and a plurality of, here nine, strip conductors **20*a*–20*i* is printed on the other side of the dielectric board 16, in a conventional manner. The strip conductors 20*a*–20*i* have triangular-shaped feed elements 22*a*–22*i* (sections 22*b* and 22*c* being shown in FIG. 2) formed at one end. The strip conductors 20*a*–20*i* are formed in parallel strips here spaced a distance of 0.349 inches. The strip conductors 20*a*–20*i* here have 50 ohm characteristic impedances. The base of each one of the triangular-shaped feed elements 22*a*–22*i* (only sections 22*a*, 22*b* and 22*c* being shown in FIG. 2) is here 0.3488 inches and the altitude is here 0.93 inches. The base dimension is selected in accordance with the requisite grating lobe requirement and the altitude dimension is selected to minimize phase errors in the H-plane (i.e. the plane of the dielectric board 16**). It has been found that the altitude should be in the order of at least $\lambda_L/2$ where $\lambda_L$ is the longest wavelength in the operating band.

The flared radiating structure 14 includes a pair of conductive members 24, 26. Conductive member 24 has formed along an edge thereof a plurality of, here nine, truncated triangular-shaped sections **28*a*–28*i*, as shown. Such sections 28*a*–28*i* are affixed, here by a suitable electrical epoxy, not shown, to cover a portion of corresponding ones of the nine feed elements 22*a*–22*i*, as shown partially in FIG. 2. The length from the base of the triangular-shaped feed elements 22*a*–22*i* which is covered by the sections 28*a*–28*i* is here 0.026 inches. It is noted that such length is less than $\lambda_S$ where $\lambda_S$ is the shortest wavelength in the operating band. Referring also again to FIG. 1, the microstrip feed network 12 feeds directly the flared radiating structure 14. The conductive member 26 is affixed to the ground plane 18, here with a suitable conductive epoxy, not shown. Referring also to FIG. 3, radiating structure 14 is flared outwardly from the edge 29 of the dielectric board 16 to free space 30. The radiating structure 14 is flared in two stages. A first one of such stages, adjacent to the edge 29**, is flared at an angle $\alpha_1$, here 28°. The second stage is flared at an angle $\alpha_2$, here 34°, in order to achieve a nominal elevation beamwidth of 30°. The length, L, of the first stage is here 0.9 inches. The length of the second stage is here 1.9 inches.

The microstrip feed network 12 is coupled to a printed circuit microwave lens 34 through coaxial cables 36a–36i in a conventional manner. As indicated more clearly in FIG. 3, the center conductor of the coaxial cable is connected via coaxial cable to microstrip connector 38 to the strip conductor 20a and the outer, or ground portion, of such connector 38 is electrically connected to the ground plane 18, here by suitable epoxy, not shown. In particular, center conductor probe 40 is affixed to strip conductor 20a and outer conductor 42 is electrically connected, by any suitable means, not shown, to the ground plane 18. A suitable printed circuit microwave lens is described in U.S. Pat. No. 3,761,936, inventors Donald H. Archer et al, issued Sept. 25, 1973 and assigned to the same assignee as the present invention. As shown in FIG. 1, the printed circuit microwave lens 34 has here seven input ports 44a–44g. The array antenna 10 is constructed so that the electrical lengths from any one of such input ports through the lens 34, the coaxial transmission lines 36a–36i and the microstrip feed network to all points on a corresponding planar wavefront are equal. It follows, then, that such antenna 10 is here adapted to produce seven independent antenna patterns. Each one of such fan-shaped radiation patterns is associated with a corresponding one of the input ports 44a–44g. That is, antenna 10 is here an H-plane multibeam array antenna.

A cover 46, here made of any suitable conductive material, is disposed over a portion of the conductive strips 20a–20i and over the feed elements 22a–22i, as shown in FIGS. 1 and 3. One side 48 of such cover 46 is affixed to conductive member 24, here by a suitable conductive solder 49. The other side, 50, of such cover 46 has slots 52a–52i formed therein. The slots 52a–52i are positioned over the strip conductors 20a–20i to prevent such conductors from contacting the cover 46. The side 50 is supported by the dielectric board 16. A radio frequency energy adsorbing material 54, here Eccosorb SF 5.5 manufactured by Emerson-Cummings, Inc., Canton, Mass., is affixed to the top, inside surface of the cover 46 by any convenient adhesive, not shown, to suppress stray radiation from the microstrip feed network. Here cover 46 has a height of 0.60 inches and a length of 2.0 inches.

A dielectric section 32, here made up of a V-shaped dielectric element 32a and a wedge-shaped dielectric element 32b is included for matching the impedance of the antenna 10 to the impedance of free space 30. It is noted that because the sides are open, the electric field at such ends are not zero and hence a substantially uniform illumination is produced across the face of the antenna 10. The V-shaped dielectric element 32a, here a silicon glass laminate dielectric material (designated as G-7 by NEMA (National Electrical Manufacturers' Association)), manufactured by Westinghouse Electric Corp., Pittsburg, Pa., having a dielectric constant of 4.2. Such dielectric element 32a is affixed to the radiating structure 14 by a suitable nonconductive epoxy, not shown. The dielectric element 32b, here oF Teflon material, is affixed to the open region of the V-shaped dielectric element 32a, as shown, by a suitable nonconductive epoxy, not shown. The lengths $l_1$, $l_2$ of the dielectric elements 32a, 32b are each approximately $\lambda/2$, where $\lambda$ is the operating wavelength in the middle of the operating band of the antenna 10. The dielectric constant of the dielectric element 32a is selected to reduce impedance mismatching between the microstrip feed network 12 and the radiating structure 14 (such structure being considered a radial waveguide). In matching this impedance, reflective effects of mutual coupling between the feed elements 22a–22i are minimized, leading to near optimum antenna gain. It is noted that such mutual coupling is relatively high in the absence of such matching because such feed elements are spaced from each other in the order of $\lambda_L/6$. The matching is optimized over the frequency band and over all seven radiation patterns, here covering $\pm$ 45° in azimuth. As mentioned above, the dielectric constant of dielectric element 32a is here 4.2. The dielectic constant of dielectric element 32b is selected to provide impedance matching between the dielectric element 32a and free space 30. The matching is optimized over the frequency band and over all seven radiation patterns. The dielectric constant of the dielectric element 32b is here 2.0.

Referring now to FIG. 4, an antenna element 60 is shown to include a microstrip feed network 62 and a flared radiating section 14' directly fed by such microstrip feed network 62. The microstrip feed network 62 includes a dielectric board 64 having a conductive ground plane 66 formed on one side thereof and a triangular-shaped conductive feed 68 formed on the other side thereof. The flared radiating structure 14' is equivalent to the flared radiating structure 14 (FIG. 1) and includes a pair of conductive members 24', 26', one, here conductive member 26' being electrically and mechanically connected to the conductive ground plane 66 and the other, here conductive member 24', being electrically and mechanically connected to the base of the triangular-shaped conductive feed 68, here by a suitable conductive epoxy, not shown in any conventional manner. Therefore, the microstrip feed network 62 directly feeds the flared radiating structure 14' as discussed in connection with FIG. 1. The apex of the triangular-shaped feed network 68 is electrically connected to the center conductor 70 of a coaxial cable to microstrip connector 72 and the outer conductor 74 of such connector 70 is electrically connected to the ground plane 66. It is noted that the conductive member 24' overlays the base a length $l_3$, which is substantially less than $\lambda_S$ in order to ensure a good electrical connection between such member 26' and the feed 68. It has been found that the altitude of the triangular-shaped feed 68 should be in the order of at least $\lambda_L/2$ where $\lambda_L$ is the longest wavelength in the operating band. A dielectric section 32', here made up of a V-shaped dielectric element 32a' and a wedge-shaped dielectric element 32b' is included for impedance matching the impedance of the antenna element 60 to free space. such dielectric section 32' is equivalent to the dielectric section 32 discussed in connection with FIG. 1 and is designed using the same considerations discussed above.

Figure 5:
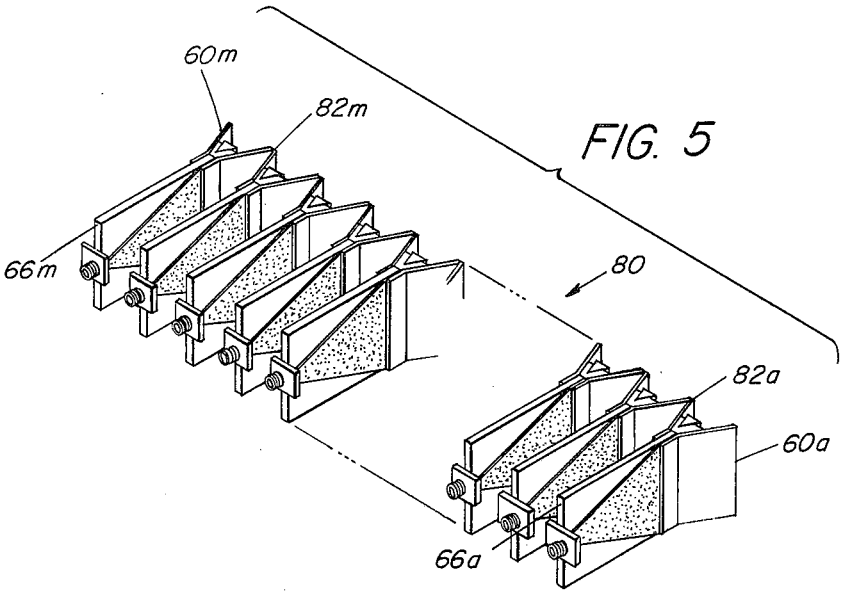

Referring now to FIG. 5, an E-plane radio frequency array antenna 80 is shown to include a plurality of the antenna elements 60a–60m. Such antenna elements 60a–60m are arranged with their dielectric boards 66a–66m disposed in parallel planes, or shown, by any suitable mounting means, not shown. As shown, the edge of a conductive member of one antenna element is electrically and mechanically connected to the edge of a conductive member of another, adjacent, antenna element, here, by a conductive epoxy, not shown, to form common edges 82a–82m. The dielectric boards 66a–66m of antenna elements 60a–60m are separated from each other by $\lambda_S/2$, where $\lambda_S$ is the smallest wavelength in the operating band to reduce grating lobes.

Having described preferred embodiments of the invention, it should now become evident to one of skill in the art that other embodiments incorporating its concepts may be used. For example, the H-plane array antenna 10 may have more or less feed elements. It is felt, therefore, that this invention should not be restricted to the disclosed embodiments but rather should be limited only by the spirit and scope of the appended claims.

What is claimed is:

1. A radio frequency antenna comprising:

a. a microstrip feed network including a dielectric board having a conductive ground plane formed on one side thereof and a plurality of feed elements formed on the other side thereof;

b. a flared radiating structure directly fed by such microstrip feed network such structure including a pair of conductive members, one being connected to the conductive ground plane and the other being connected to the plurality of feed elements; and, c. a dielectric structure disposed in the narrow region of the flared radiating structure including a first dielectric means for providing inpedance matching between the microstrip feed network and the radiating structure and a second dielectric means for providing impedance matching between the first dielectric means and the impedance of free space.

2. The radio frequency antenna recited in claim 1 wherein the first dielectric means is a V-shaped dielectric element having its apex disposed within the narrow region of the flared radiating structure, and wherein the second dielectric means is a triangular-shaped dielectric element having its apex disposed within the open portion of the V-shaped dielectric element.

3. The radio frequency antenna recited in claim 2 wherein the dielectric constant of the first dielectric means is greater than the dielectric constant of the second dielectric means.

4. An E-plane radio frequency array antenna comprising: a plurality of antenna elements, each one of such antenna elements including a microstrip feed network having a triangular-shaped feed element disposed on one side of a dielectric planar board and a conductive ground plane disposed on the other side of such dielectric board and a flared radiating structure fed by such feed element, such flared radiating structure including a pair of conductive members, the plurality of antenna elements being arranged with their dielectric boards disposed in parallel planes, the edge of one of the conductive members of one of such antenna elements being electrically connected to the edge of one of the conductive members of an adjacent one of the antenna elements, the dielectric boards being separated from each other $\lambda_S/2$ where $\lambda_S$ is the smallest wavelength in the operating band in the antenna, and wherein each one of the antenna elements includes a dielectric structure disposed in the narrow region of the flared radiating structure to provide impedance matching between the antenna and free space.

5. The radio frequency array antenna recited in claim 4 wherein the dielectric structure includes a V-shaped dielectric element having its apex disposed within the narrow region of the flared radiating structure and a triangular-shaped dielectric element having its apex disposed within the open portion of the V-shaped dielectric element.

6. The radio frequency array antenna recited in claim 5 wherein the dielectric constant of the V-shaped dielectric element is greater than the dielectric constant of the triangular-shaped dielectric element.

7. A radio frequency antenna comprising:

a. a microstrip feed network including a dielectric board having a conductive ground plane formed on one side thereof and a plurality of feed elements formed on the other side thereof, each one of such feed elements being triangularly shaped having its apex coupled to a corresponding output port and its base connected to a common conductive strip disposed about an edge of the feed network;

b. a flared radiating structure directly fed by such microstrip feed network, such structure including a pair of conductive elements, one being connected to the ground plane and the other being connected to the common conductive strip;

c. a printed circuit parallel plate radio frequency lens having a plurality of output ports and a plurality of input ports each one of such input ports being associated with a different one of a plurality of beams of radio frequency energy;

d. a plurality of transmission lines for connecting each one of the output ports of the radio frequency lens to a corresponding one of the output ports coupled to the apex of the feed elements the electrical lengths of such transmission lines being selected so that the electrical length from a corresponding one of the input ports to all points on a corresponding plane or wavefront are equal; and e. a dielectric structure disposed in the narrow region of the flared radiating structure to provide impedance matching between the array antenna and free space.

8. The radio frequency array antenna recited in claim 7 wherein the dielectric structure includes a V-shaped dielectric element having its apex disposed within the narrow region of the flared radiating structure and a triangular-shaped dielectric element having its apex disposed within the open portion of the V-shaped dielectric element.

9. The radio frequency antenna array recited in claim 8 wherein the dielectric constant of the V-shaped dielectric element is greater than the dielectric constant of the triangular-shaped dielectric element.

10. The radio frequency array antenna recited in claim 9 including absorbing means disposed above the feed network for absorbing stray radiation propagating from such feed network.

* * * * *